US009084458B2

(12) United States Patent
Crowhurst

(10) Patent No.: US 9,084,458 B2
(45) Date of Patent: Jul. 21, 2015

(54) WALKING AID INCLUDING A BENDABLE PUCK COUPLED BETWEEN A FOOT AND HANDLE

(71) Applicant: ZOOMWORKS LLC, Minnetonka, MN (US)

(72) Inventor: Christopher Crowhurst, Savage, MN (US)

(73) Assignee: HurryCane LLC, Minneapolis, MN (US)

( * ) Notice: Subject to any disclaimer, the term of this patent is extended or adjusted under 35 U.S.C. 154(b) by 3 days.

(21) Appl. No.: 13/858,680

(22) Filed: Apr. 8, 2013

(65) Prior Publication Data

US 2014/0299168 A1 Oct. 9, 2014

(51) Int. Cl.
*A45B 9/04* (2006.01)
*A61H 3/02* (2006.01)

(52) U.S. Cl.
CPC ..... *A45B 9/04* (2013.01); *A61H 3/0288* (2013.01); *A61H 2003/0205* (2013.01); *A61H 2003/0283* (2013.01); *A61H 2201/0161* (2013.01); *Y10T 29/49826* (2015.01)

(58) Field of Classification Search
CPC ..... A45B 9/04; A61H 3/0288; A61H 3/0277; A61H 2003/0283
USPC ..... 135/77, 82, 84, 86
See application file for complete search history.

(56) References Cited

U.S. PATENT DOCUMENTS 765,984 A * 7/1904 Morris et al. ..... 135/84
1,369,580 A * 2/1921 Uchytil ..... 135/86
2,453,742 A * 11/1948 Bowen et al. ..... 135/77
2,538,658 A * 1/1951 Saurer ..... 267/141.5
2,753,586 A * 7/1956 Metz ..... 16/18 R
3,163,437 A * 12/1964 Phillipson ..... 280/824
3,731,698 A 5/1973 Buchalter
4,044,784 A * 8/1977 Smith ..... 135/67
4,135,536 A 1/1979 Willis
4,440,186 A * 4/1984 Lottner ..... 135/84
4,899,771 A 2/1990 Wilkinson
4,947,882 A 8/1990 Levasseur
5,640,986 A 6/1997 Herman
5,711,334 A 1/1998 Roux
5,865,204 A 2/1999 Bracy (Continued)

FOREIGN PATENT DOCUMENTS

| | | |
|---|---|---|
| CA | 449581 | 7/1948 |
| DE | 4108834 | 9/1992 |
| GB | 1181795 | 2/1970 |

OTHER PUBLICATIONS

U.S. Appl. No. 29/451,763, filed Apr. 8, 2013, Crowhurst.

(Continued)

*Primary Examiner* — Noah Chandler Hawk

(74) *Attorney, Agent, or Firm* — Fish & Richardson P.C.

(57) ABSTRACT

An example can include an apparatus for aiding walking along a surface. The example can include a foot to interface with the surface, the foot being rigid to resist bending during walking. The example can include a bendable puck fixed to the foot at an edge of the bendable puck. The example can include a handle coupled to a center portion of the bendable puck. In the example, the foot can be spaced apart from the handle, with the puck being elastically bendable to permit movement of the handle with respect to the foot during walking.

10 Claims, 22 Drawing Sheets

(56) References Cited

U.S. PATENT DOCUMENTS

| | | | | |
|---|---|---|---|---|
| 6,601,818 | B1 * | 8/2003 | Larsen | 248/621 |
| 6,883,530 | B2 | 4/2005 | Kawakami et al. | |
| 7,047,990 | B2 | 5/2006 | Zambrano et al. | |
| 7,581,556 | B2 | 9/2009 | Haslach, Jr. et al. | |
| 7,588,044 | B2 * | 9/2009 | Baker | 135/82 |
| 7,611,413 | B2 | 11/2009 | Ryan et al. | |
| 7,637,274 | B1 | 12/2009 | Dodson | |
| 7,647,937 | B2 | 1/2010 | Gordon | |
| 7,748,396 | B2 | 7/2010 | Lasota | |
| 8,166,990 | B2 | 5/2012 | Daily | |
| 8,176,927 | B2 | 5/2012 | Wu | |
| 8,596,288 | B2 | 12/2013 | Daily | |
| 8,671,962 | B1 | 3/2014 | Dodson | |
| 8,707,975 | B2 | 4/2014 | Larson et al. | |
| 2006/0219280 | A1 * | 10/2006 | Robinson et al. | 135/84 |
| 2006/0254632 | A1 * | 11/2006 | Willis | 135/74 |
| 2013/0032185 | A1 * | 2/2013 | Sato | 135/68 |

OTHER PUBLICATIONS

International Search Report and Written Opinion in International Application No. PCT/US2013/036181, mailed Feb. 13, 2014, 14 pages.

HurryCane Maintenance and Acessories, martFIVE, LLC., 2013, 1 page.

HurryCane Setup Instructions, HurryCane The all-terrain cane, 2013, 1 page.

HurryCane Certificate of Authenticity, 2013, 2 pages.

HurryCane Freedom Edition Setup Instructions, Oct. 2013, 2 pages.

HurryCane Setup Instructions, 2012, 2 pages.

"The HurryCane as Seen on TV—Foldable Walking Cane that Stands on its own with 3 Points of Contact," thehurrycane.com, Jun. 7, 2012, retrieved on Oct. 13, 2014, https://web.archive.org/web/20120607055811/http://thehurrycane.com/(S(06b99a2f1a264eec9d6b7253cf0f33a4))/, 2 pages.

* cited by examiner

WALKING AID INCLUDING A BENDABLE PUCK COUPLED BETWEEN A FOOT AND HANDLE

BACKGROUND

A problem with walking aids is that the ground-facing portion of the device, e.g. to foot, does not always conform well to the surface a walker is traversing. Several attempts have been made to improve the ability a walking aid has to interface with the ground. U.S. Pat. No. 5,640,986 shows footer assemblies that include foot pads for contact with a ground or flooring surface and attachment brackets that mount the foot pad to the lower end of a vertical support assembly having support rods interconnected by spaced connection members. However, such footer assemblies do not provide an ability for the foot pad to rotate laterally relative to the vertical support assembly, and thus if the vertical support assembly is extended laterally of the user, the foot pad will become angled relative to the ground flooring surface. This will reduce the effectiveness of the footer assembly to operate properly. Extending the vertical support assembly of a mobility assist device can be quite advantageous in providing a wide, and thus stable, support base for the user.

U.S. Pat. No. 4,135,536 references a foot member, preferably molded as a unit from rubber, having a gripper pad, a crutch holder and an interposed sleeve portion. A pivot pin preferably has a disc-like upper portion disposed within the crutch holder, and a depending pin portion extending through the sleeve portion and into the gripper pad. However, it is apparent that the device is difficult to service, and can generate noise when the pivot pin contacts the depending pin portion, which can irritate the user.

U.S. Pat. No. 4,899,771 references a walking aid for use in combination with a cane, crutches or the like having a foot member provided with a centrally located base formed with a central socket for insertably receiving the foot end of the cane or crutch. The foot member is provided with several raised reinforcement ribs on its top surface that radiate outwardly between the socket and the base. This walking aid suffers from a shortcoming, however, in that a contact patch with the ground is limited to being less than the entire area of the walking device in order to accommodate rolling of the foot member of the waling aid. This can reduce the fictive force available from the walking aid.

SUMMARY

The present inventors have recognized, among other things, that a problem to be solved can include providing a multi-direction articulable walking aid. The present subject matter can provide a solution to this problem, such as by providing a bendable puck to couple a handle to a foot. Bending the puck can allow for motion of the foot with respect to a handle.

The present inventors have recognized, among other things, that a problem to be solved can include providing a walking aid that can stand on its own. The present subject matter can provide a solution to this problem, such as by providing a foot of an aspect ratio sized to resist tipping.

The present inventors have recognized, among other things, that a problem to be solved can include providing a walking aid that does not click in use. The present subject matter can provide a solution to this problem, such as by providing a bendable puck that can accommodate elastic motion while damping vibration, including noise-producing vibration.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different two-digit suffixes may represent different instances of similar components. The drawings illustrate generally, by way of example, but not by way of limitation, various embodiments discussed in the present document.

DETAILED DESCRIPTION

Figure 1:
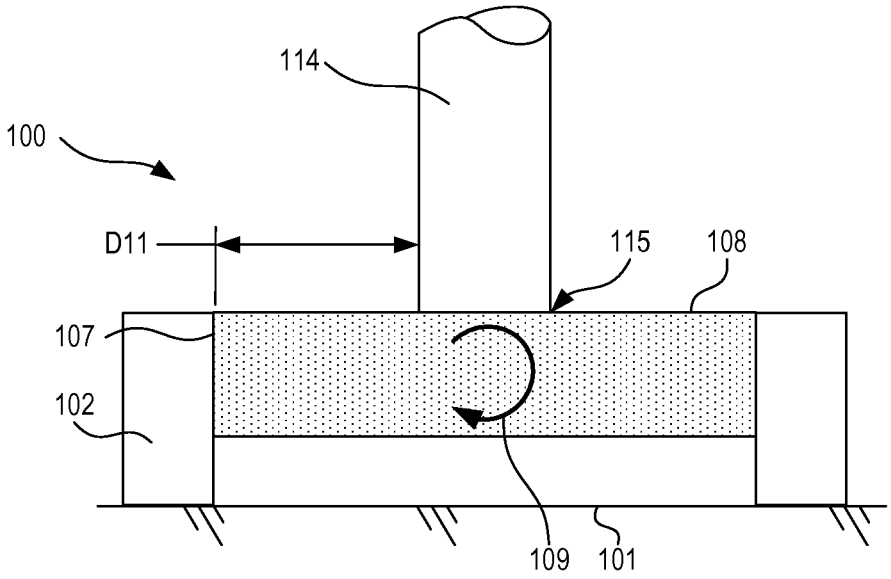
FIG. 1 shows a side cross-section view of a walking aid including a handle and a foot, according to an example.
Figure 8A:
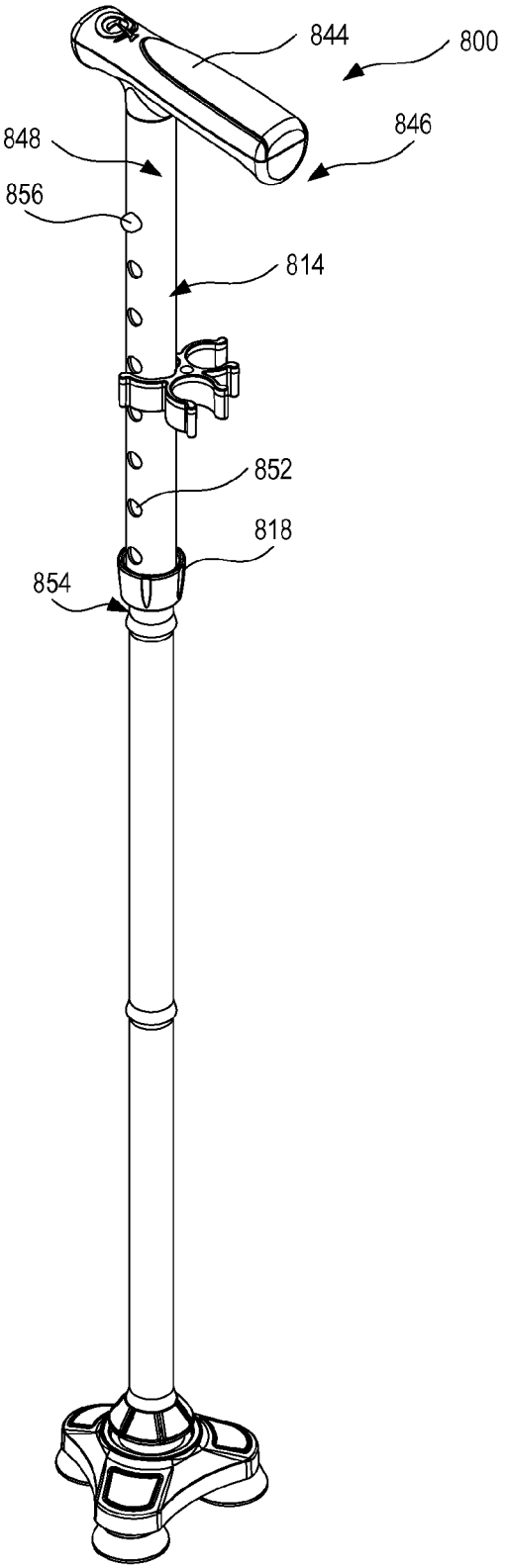
FIG. 8A is an elevated front right perspective view of a walking aid, according to an example.
Figure 9A:
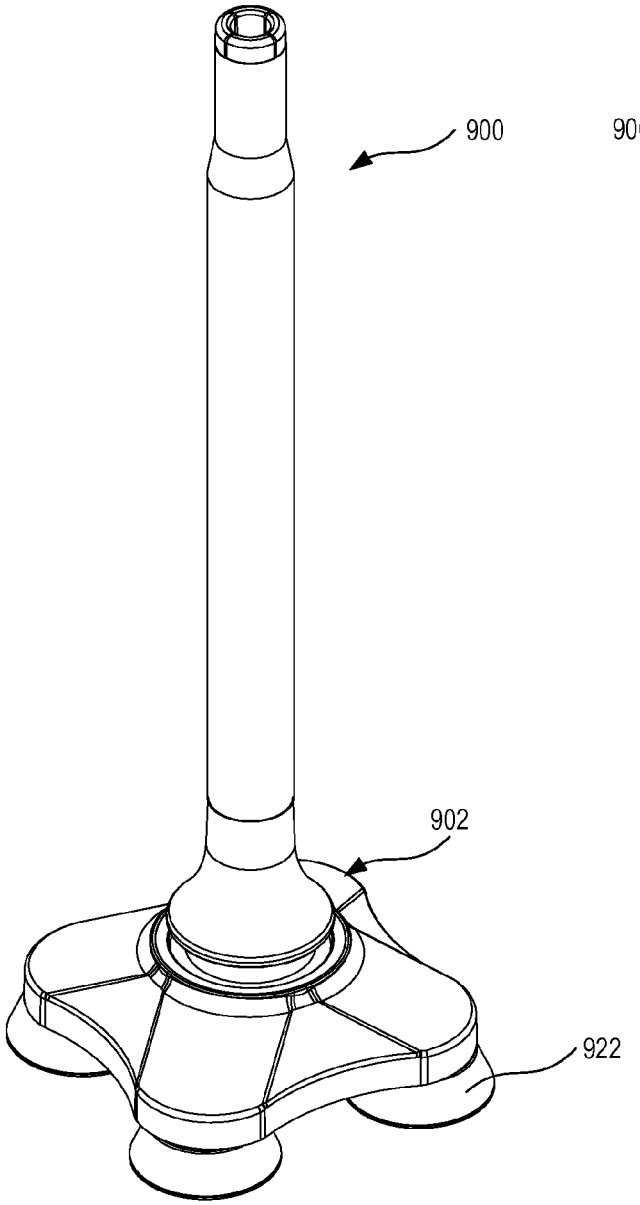
FIG. 9A is an elevated front right perspective view of a bottom portion of a walking aid, according to an example.
Figure 9B:
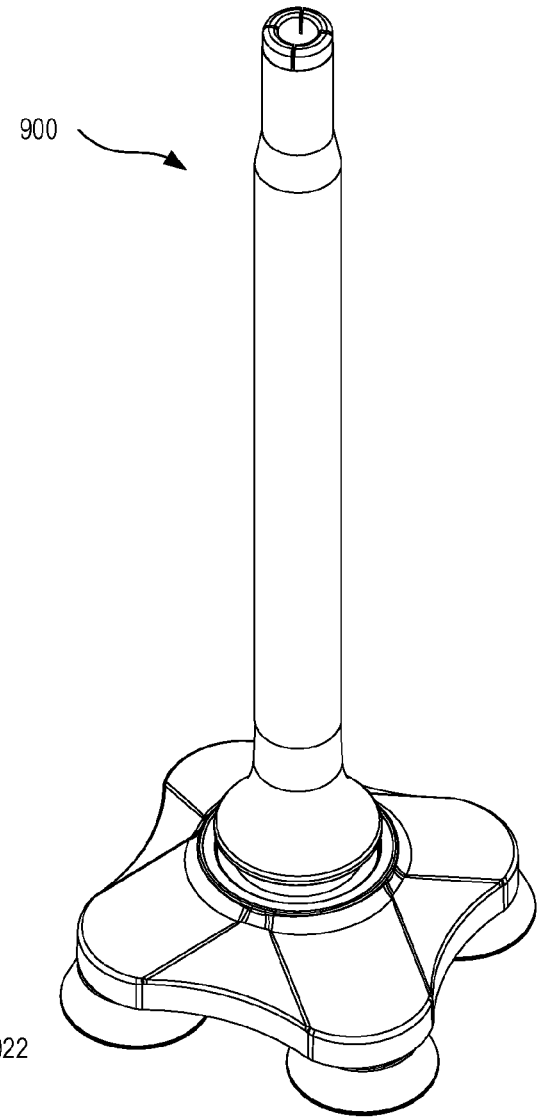
FIG. 9B is an alternative elevated front right perspective view of a bottom portion of a walking aid, according to an example.
Figure 9C:
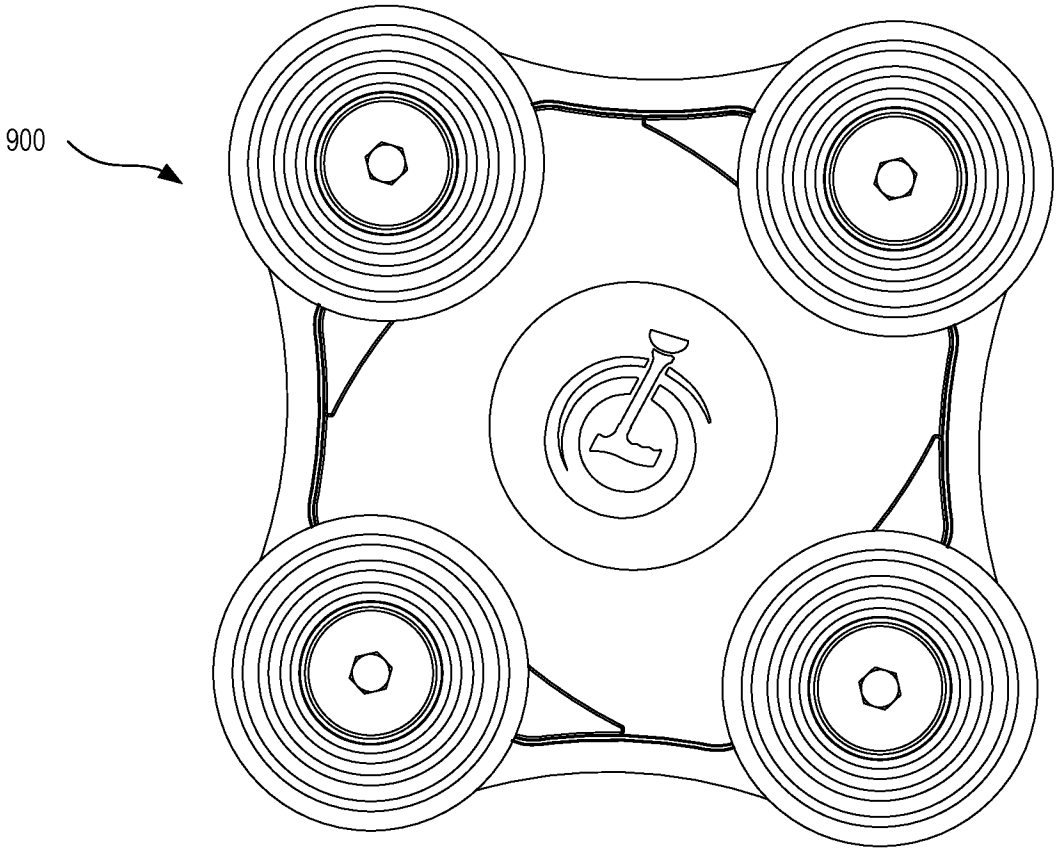
FIG. 9C is a bottom view of a bottom portion of a walking aid, according to an example.
Figure 9D:
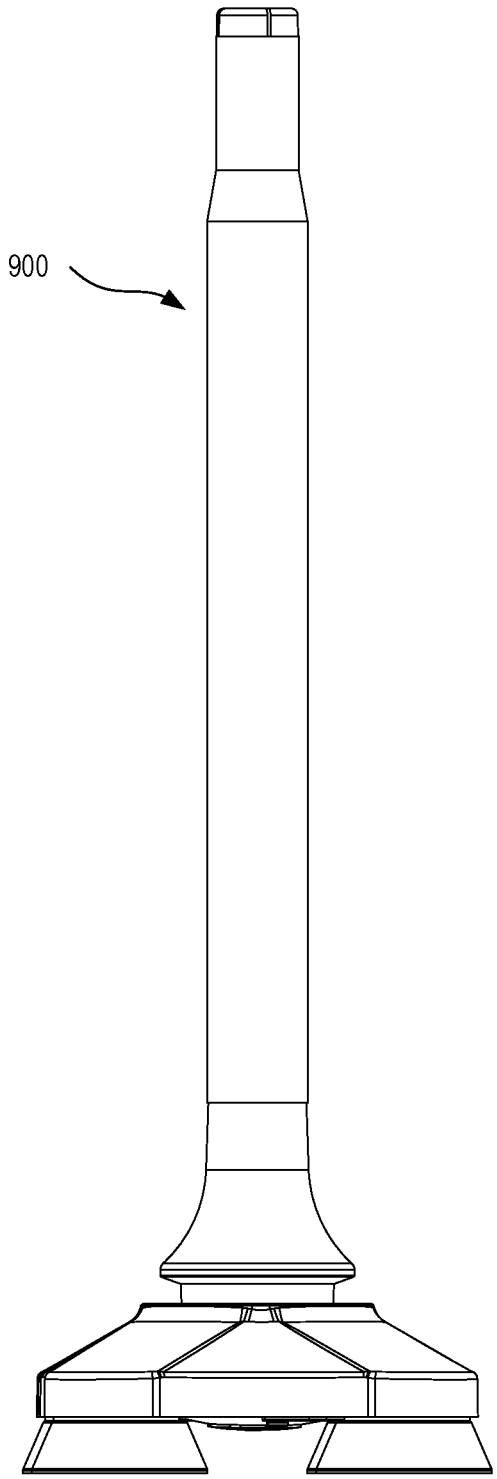
FIG. 9D is a front view of a retracted bottom portion of a walking aid, according to an example.
Figure 9E:
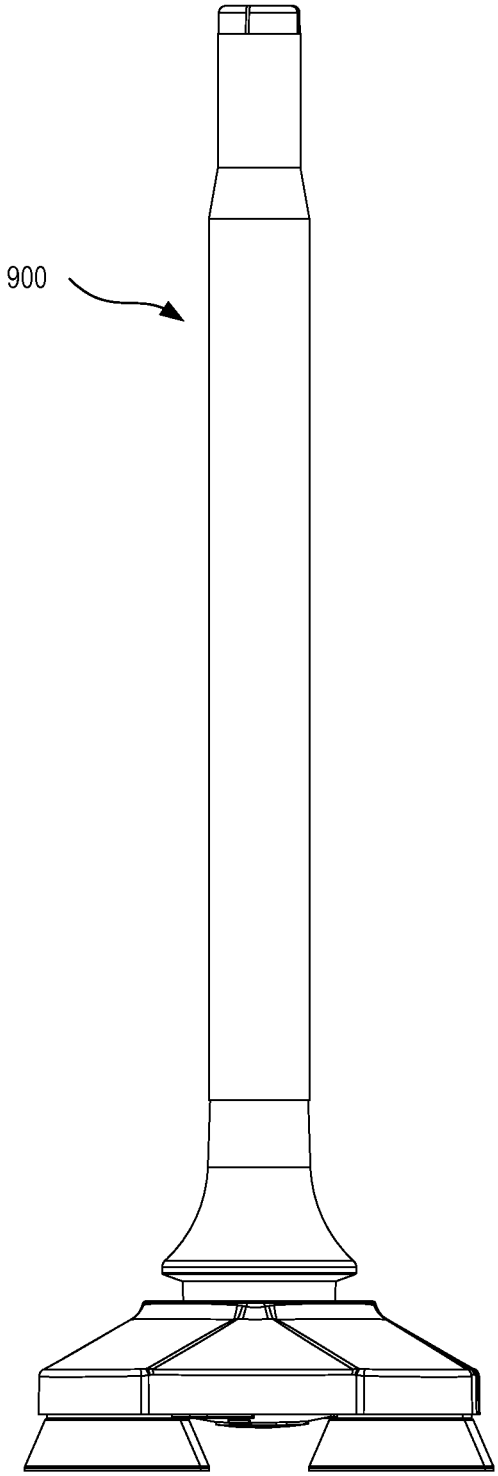
FIG. 9E is a right view of an extended bottom portion of a walking aid, according to an example.
Figure 9F:
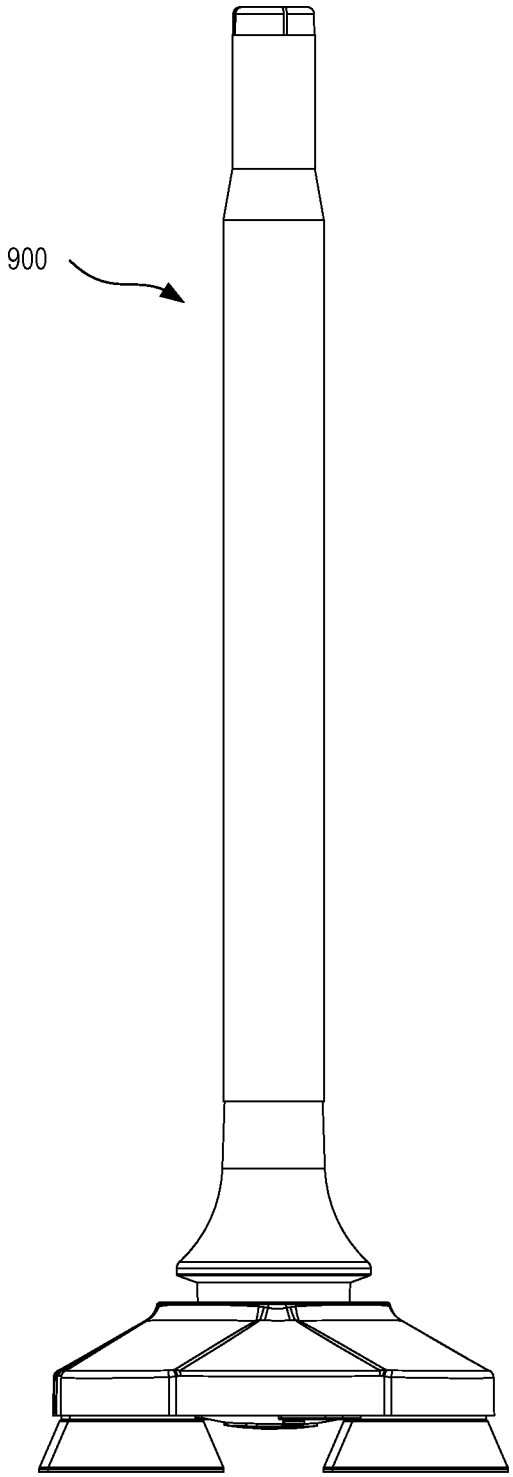
FIG. 9F is a rear view of an extended bottom portion of a walking aid, according to an example.
Figure 9G:
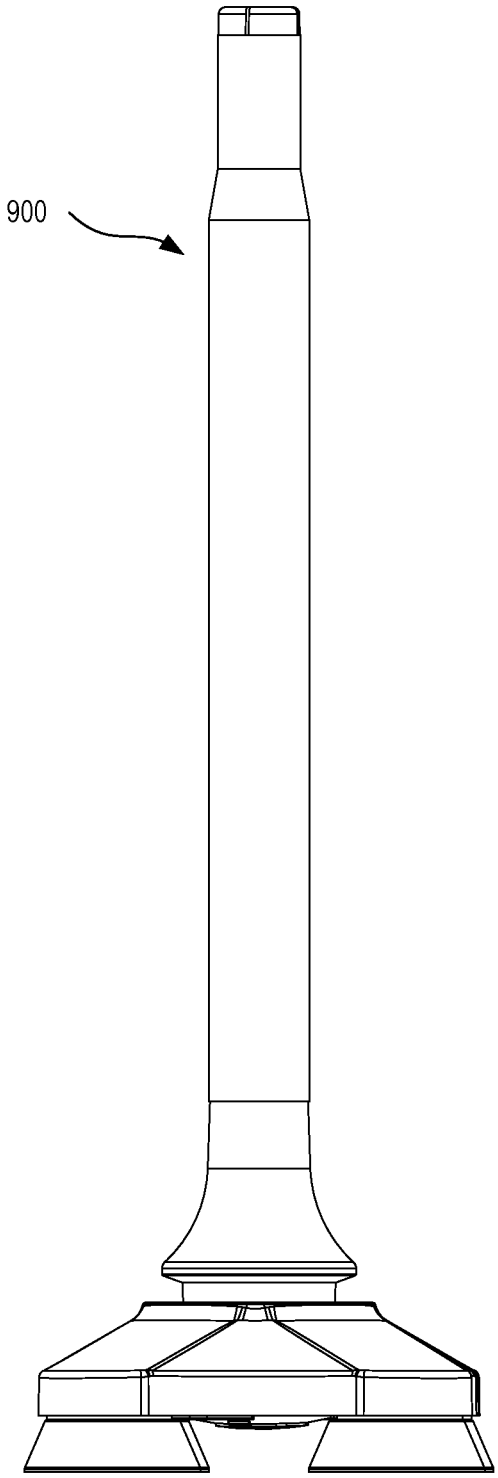
FIG. 9G is a left view of an extended bottom portion of a walking aid, according to an example.
Figure 9H:
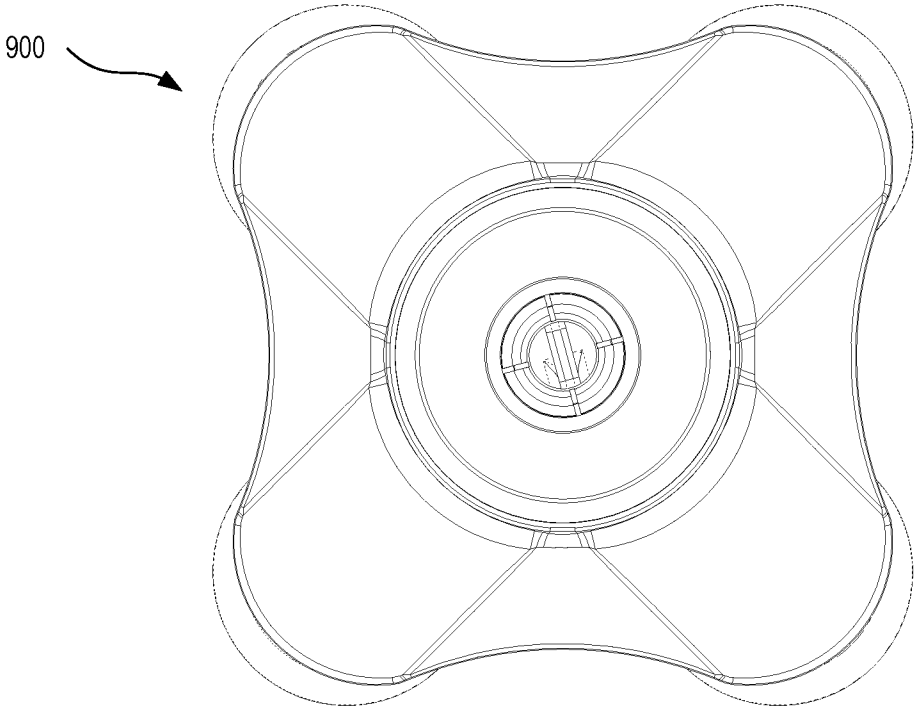
FIG. 9H is a top view of a bottom portion of a walking aid, according to an example.

FIG. 1 shows a side cross-section view of a walking aid including a handle and a foot, according to an example. The walking aid 100 can be for aiding walking along a surface 101, such as the ground. The walking aid can form a part of, or serve as, a cane, crutch, walker, prosthetic and the like. The walking aid 100 can include a foot 102 to interface with the surface 101. The foot 102 can be rigid to resist bending during walking. The foot can be formed out of a rigid material, including, but not limited to, a metal, a plastic, such as a thermoformed plastic, wood, and the like. A bendable puck 108 can be fixed to the foot 102, such as at an edge 107 of the bendable puck 108. The foot 102 can be affixed to a bottom, a top, otherwise coupled with the bendable puck 108, such as to impart a torque 109 onto the bendable puck 108. The foot can comprise one or more pads, for example 3 or 4 pads as illustrated in FIGS. 8A and 9A, respectively. The 104 foot can comprise a single foot, such as a barrel to encompass the puck 108. The foot can be molded to encompass the bendable puck 108, as is shown herein, such as in FIG. 2.

A handle 114 can be coupled to the bendable puck 108. The handle 114 can be coupled to a center portion 115 of the bendable puck. The foot 102 can be spaced apart D11 from the handle 114. The puck 108 can be elastically bendable to permit movement of the handle with respect to the foot during walking. The puck 108 is shown in cross-section. In the top view, it can have a circular, rectilinear, or polygonal, irregular, or some other shape. The puck can be formed of a polymer, such as rubber. The puck can be of a durometer of, or substantially near to, 60 Shore "A", such as being within +/−5 Shore "A".

Figure 2:
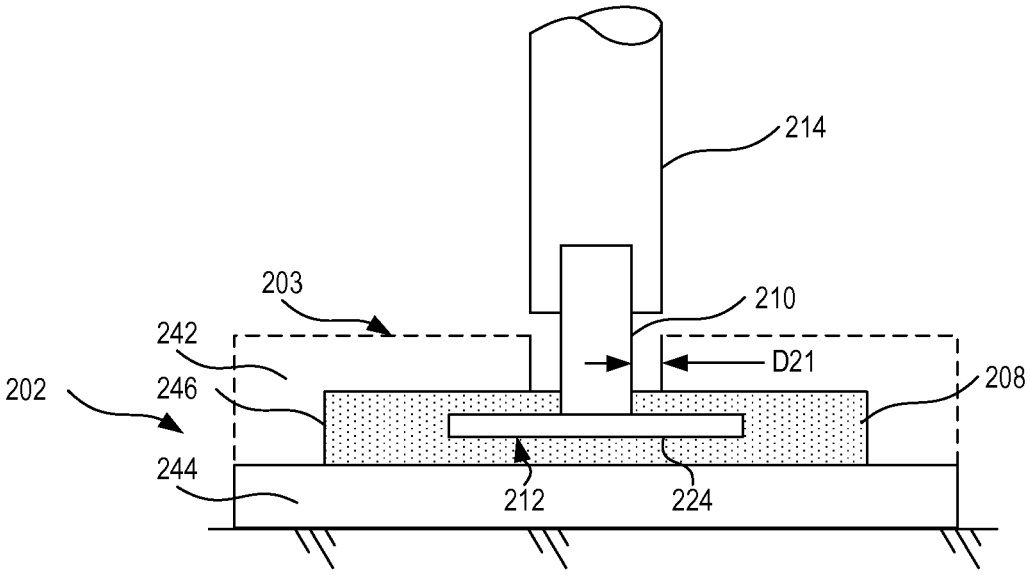
FIG. 2 shows a side cross-section view of a bendable puck molded around a fastener, according to an example.

FIG. 2 shows a side cross-section view of a bendable puck molded around a fastener, according to an example. A foot 202 can comprise a housing 203. The housing 203 can be conformed to a puck 208. The housing can include an optional top portion 242 and a bottom portion 244. The bottom portion can be glued to the puck 208. The top portion 242 and the bottom portion 244 can be monolithic. The bottom portion 244 can include a perimeter 246 that is coextensive with a perimeter 248 of the puck 208, or they can be staggered as illustrated.

The housing 203 can at least partially envelop the puck 208. A fastener 212 can include a threaded portion 210. The threaded portion 210 can extend through the housing 203. The housing 203 can be spaced apart from the threaded portion 210, such as by a distance D21.

The puck 208 can be molded around the fastener 212. The fastener 212 can include a disk-shaped portion 224. The puck 208 can be molded around the disk-shaped portion 224. The threaded portion 210 of the fastener 212 can extend away from the disk-shaped portion 224. The fastener 212, e.g. including a threaded portion 210, can extend through the puck 208 upward. The fastener 212 can be coupled to a handle 214. The handle 214 can be coupled with the threaded portion 210, for example.

Figure 3:
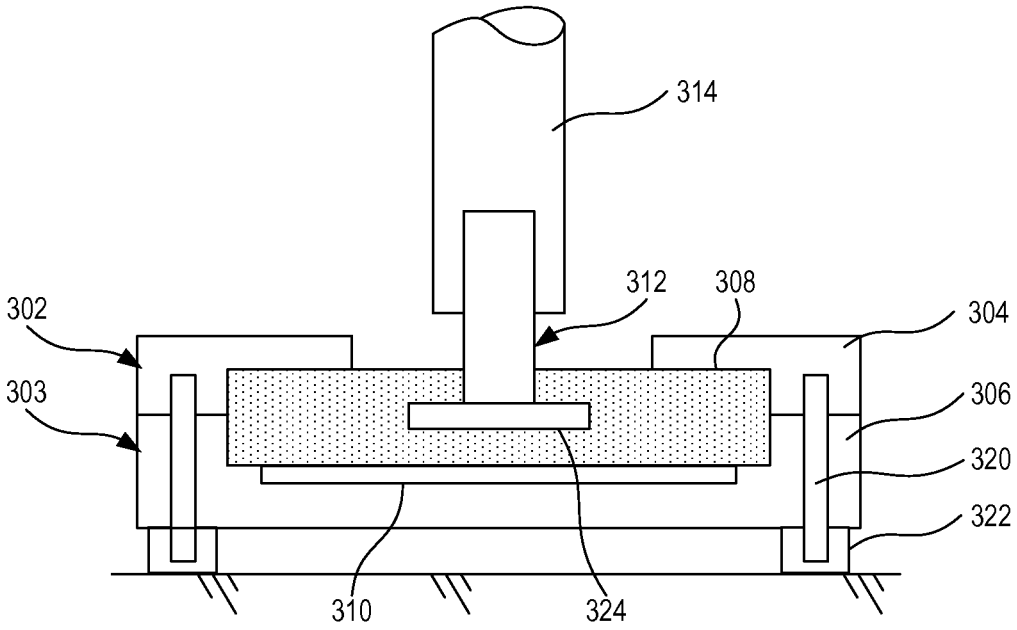
FIG. 3 shows a side cross-section view of a two-part housing retaining a bendable puck, according to an example.

FIG. 3 shows a side cross-section view of a two-part housing retaining a bendable puck, according to an example. A foot 302 can include a top cover 304 coupled to a bottom cover 306 of the foot 302, to define a housing for a puck 308. The puck 308 can be sandwiched between the top cover 304 and the bottom cover 306, such as to retain the puck 308. A handle 314 can be coupled with the puck 308 via a fastener 312. The fastener 312 can include a disk-shaped portion 324 around which the puck 308 is formed, to maintain the fastener 312 in alignment oriented up with respect to the puck 308. Thus, the handle 314 can be coupled to the foot 302 via interconnection with the fastener 312 and the puck 308.

The foot 302 can define a cavity 310 between the puck 308 and the foot 302. The housing 303 can define a cavity 310 disposed between the housing 303 and the puck 308, such as between the bottom cover 306 and the puck 308. The cavity 310 can be disposed in the housing, as illustrated. It can also be formed in the puck 308, or in both the puck 308 and the housing 303. The puck 308 can be suspended inside the housing 303, defining the cavity 310 below it. The cavity allows the puck 308 to deform therein, such as when the handle 314 is moved in relation to the foot 302.

Such movement imparts stresses on the housing 303. Accordingly, at least one fastener 320 can couple the bottom cover 306 to the top cover 304. The at least one fastener 320 can couple a pad 322 to the housing 303 as well, which can decrease complexity of the walking aid. The pad can be formed of a polymer, such as rubber. The pad can be of a durometer of, or substantially near to, 60 Shore "A", such as being within +/−5 Shore "A". The handle 314 can be spaced apart from both the bendable puck 308 and the housing 303 as illustrated, although the present subject matter is not so limited.

Figure 4:
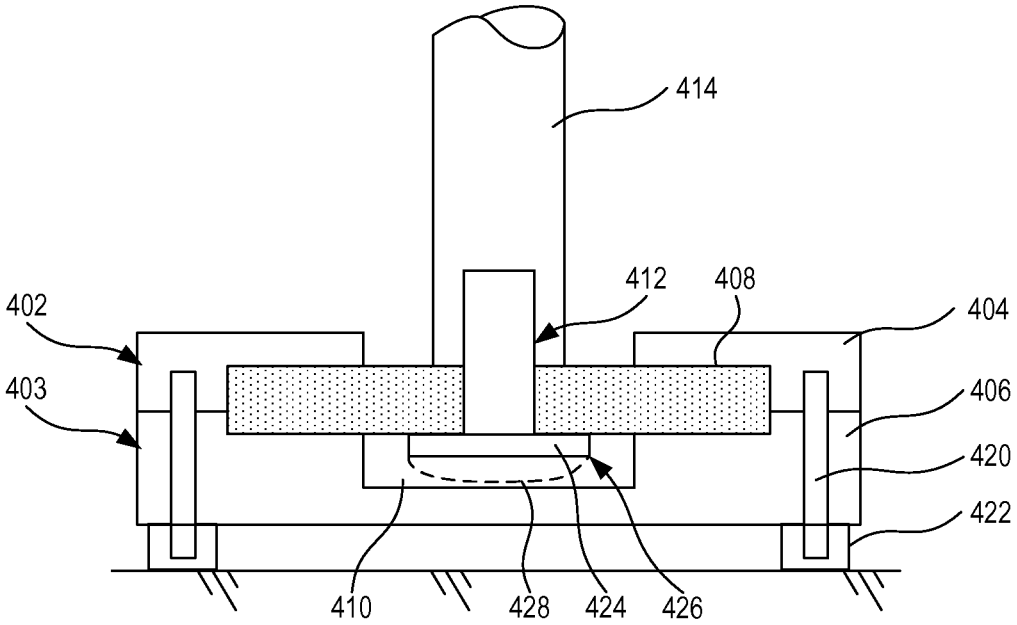
FIG. 4 shows a side cross-section view of a two-part housing retaining a bendable puck, with a fastener disposed through the puck, according to an example.

FIG. 4 shows a side cross-section view of a two-part housing retaining a bendable puck, with a fastener disposed through the puck, according to an example. In contrast to FIG. 3, the handle 414 can be spaced apart only from the housing 403 as illustrated. The fastener 412 can coupled to the puck and the handle, through the puck, with a bottom portion 426 of the fastener 412 extending below the bendable puck. The bottom portion 426 of the fastener 412 can be sandwiched between the puck 408 and the housing 403. The bottom portion 424 of the fastener 412 can be disposed in the cavity.

The fastener 412 can optionally be ball shaped, as shown in dashed lines. A downward facing portion 428 can be curvilinear in cross-section, such as when the fastener 412 approximates a spherical shape. The fastener can optionally contact the housing 403, such as along a bottom housing portion 406. The bottom housing portion 406 can be shaped to conform to the fastener 412. Contact between the housing 403 and the fastener 412 can increase the load-carrying ability of the walking aid, but can result in grinding noises and/or clicking in use.

Figure 5:
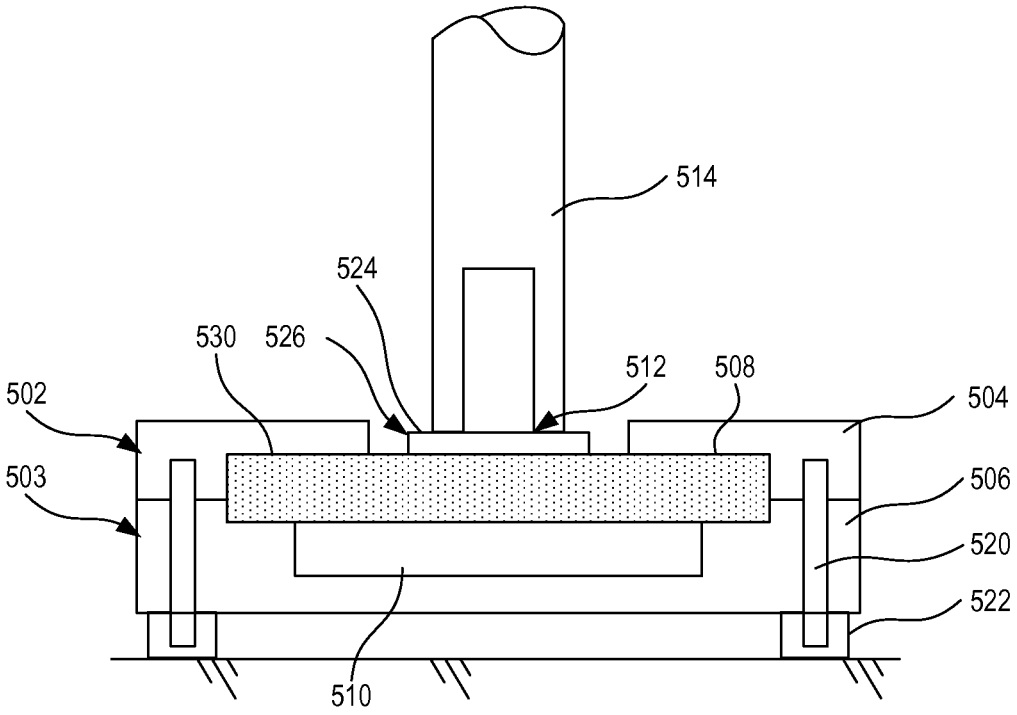
FIG. 5 shows a side cross-section view of a two-part housing retaining a bendable puck, with a fastener disposed on the puck, according to an example.

FIG. 5 shows a side cross-section view of a two-part housing retaining a bendable puck, with a fastener disposed on the puck, according to an example. In contrast to FIG. 4, the fastener 512 can be coupled to a top portion 530 of the puck 508. The fastener 512 can be adhered to the puck 508. The fastener 512 can be coupled to the puck with fasteners, such as screws. The fastener 512 can otherwise be coupled to a top portion of the puck 508, such as by be screwed into the puck 508.

Figure 6A:
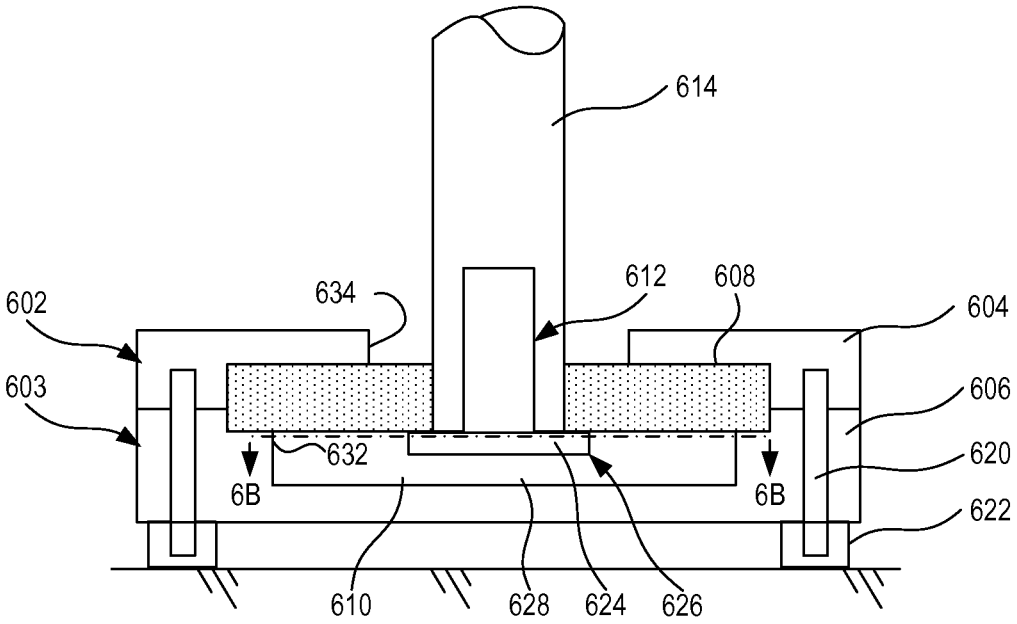
FIG. 6A shows a side cross-section view of a two-part housing retaining a bendable puck, with a handle disposed through the puck, according to an example.
Figure 6B:
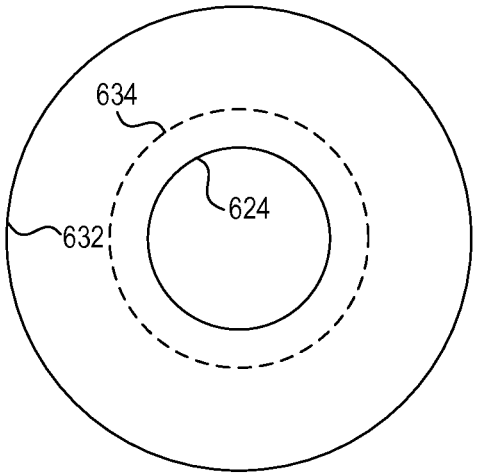
FIG. 6B shows a sectional view taken along line 6B-6B in FIG. 6A.

FIGS. 6A-B show views of a two-part housing retaining a bendable puck, with a handle disposed through the puck, according to an example. In contrast to FIG. 4, the handle 612 can extend through the puck 608. A perimeter 632 of the cavity 610 can be wider than the fastener 612. The perimeter 632 of the cavity along a horizontal cross-section, encircles a perimeter of the fastener taken along a second horizontal cross-section parallel a first horizontal cross-section. The perimeter 632 of the cavity 610 can be wider than a housing opening 634 through which the fastener 612 extends.

Figure 7:
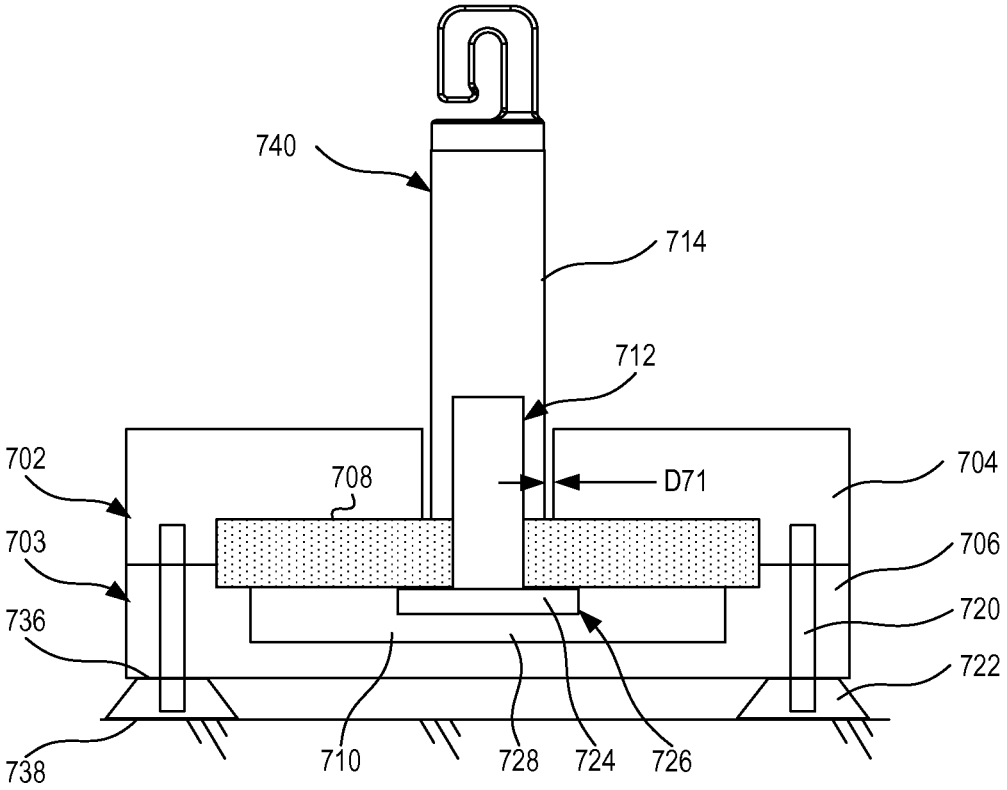
FIG. 7 shows a side cross-section view of a two-part housing retaining a bendable puck, with a fastener disposed through the puck, and with pads coupled to the housing, according to an example.

FIG. 7 shows a side cross-section view of a two-part housing retaining a bendable puck, with a fastener disposed through the puck, and with pads coupled to the housing, according to an example. The foot 702 can include a plurality of frustoconical pads 722. The frustoconical pads 722 can be wider at a bottom 736 than at a top 738.

The top cover 704 can be thick along a vertical measurement, to support and constrain total deformation of the handle 714 with respect to the housing 702. The distance D71 can be selected to limit such deformation. Such a limit can protect the puck 708 from inelastic deformation such as that incurred in catastrophic failure. As illustrated, a bottom portion 740 of the handle 714 can be coupled to a hook 724 to couple with an elastic band disposed in the handle 714.

Figure 8B:
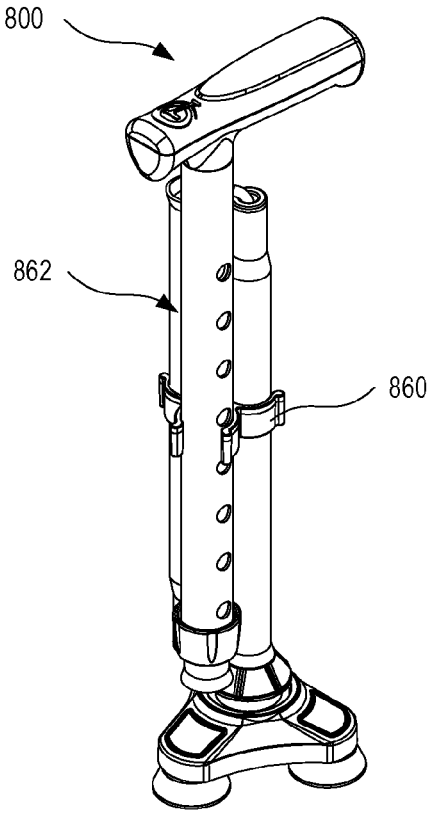
FIG. 8B is an elevated front left perspective view of a collapsed walking aid, according to an example.
Figure 8C:
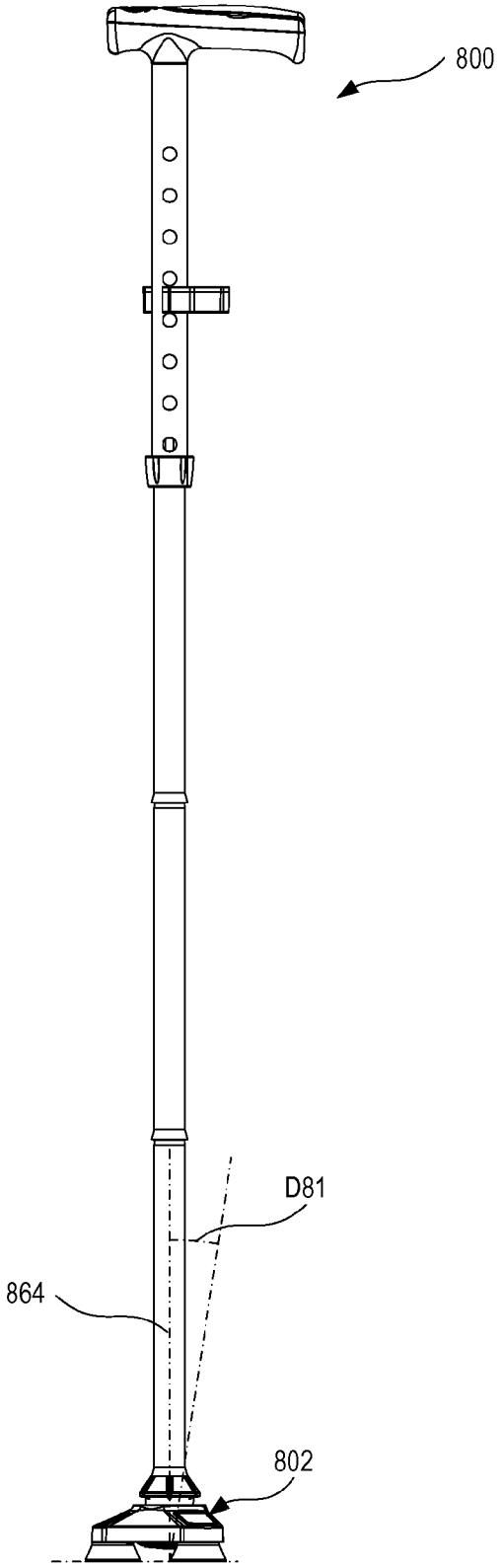
FIG. 8C is a front view of an extended walking aid, according to an example.
Figure 8D:
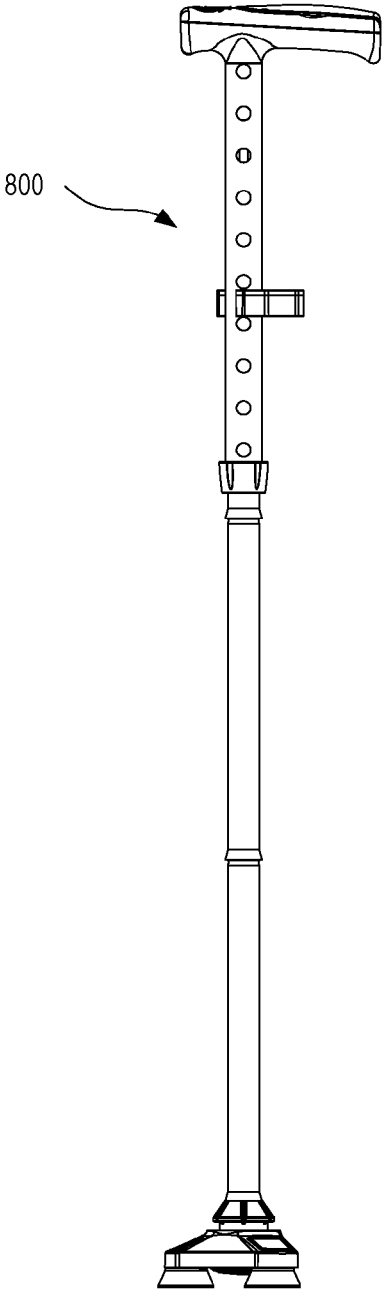
FIG. 8D is a front view of a retracted walking aid, according to an example.
Figure 8E:
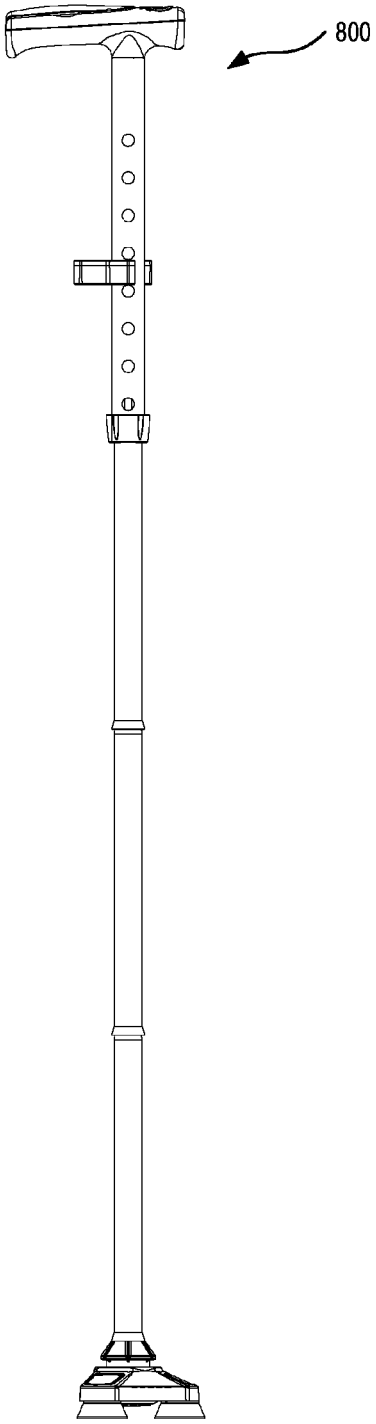
FIG. 8E is a rear view of an extended walking aid, according to an example.
Figure 8F:
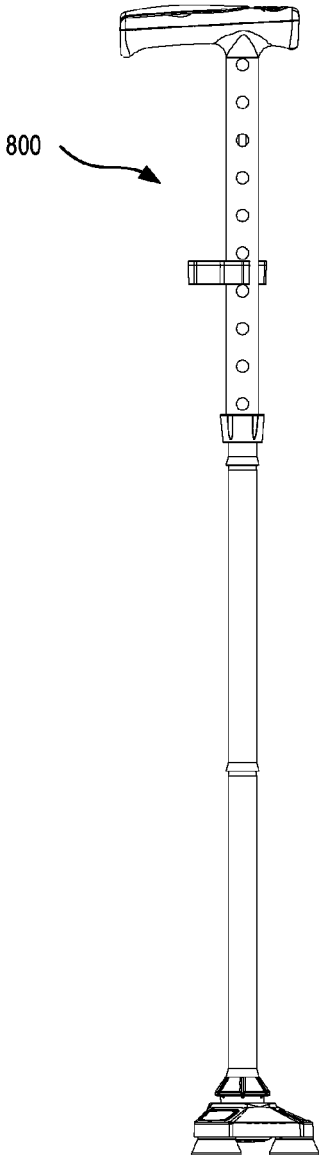
FIG. 8F is a rear view of a retracted walking aid, according to an example.
Figure 8G:
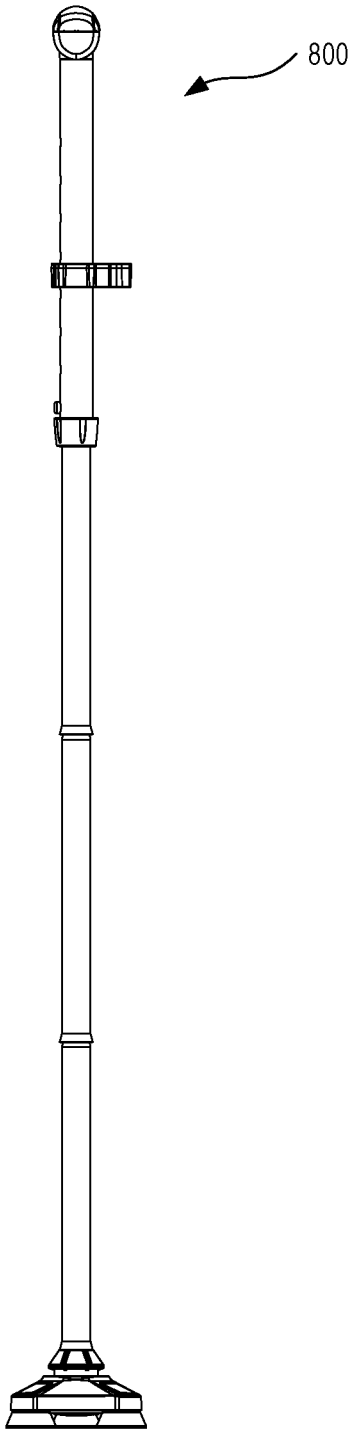
FIG. 8G is a right view of an extended walking aid, according to an example.
Figure 8H:
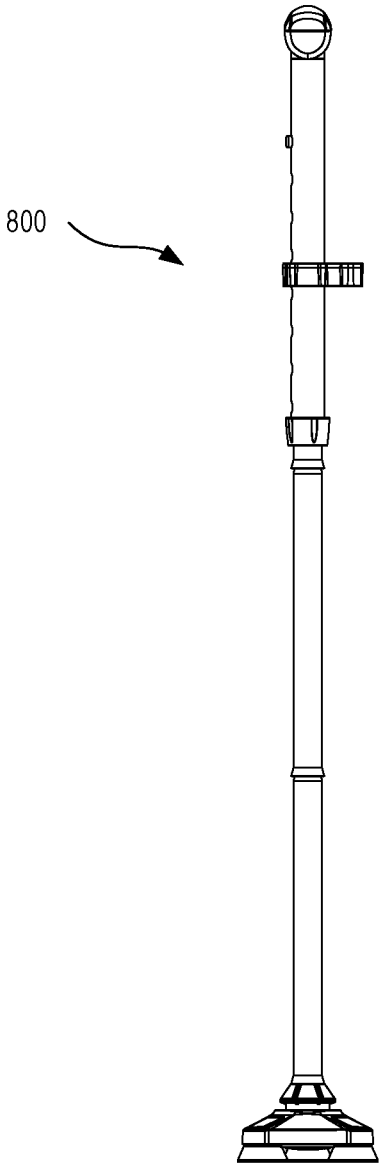
FIG. 8H is a right view of a retracted walking aid, according to an example.
Figure 8I:
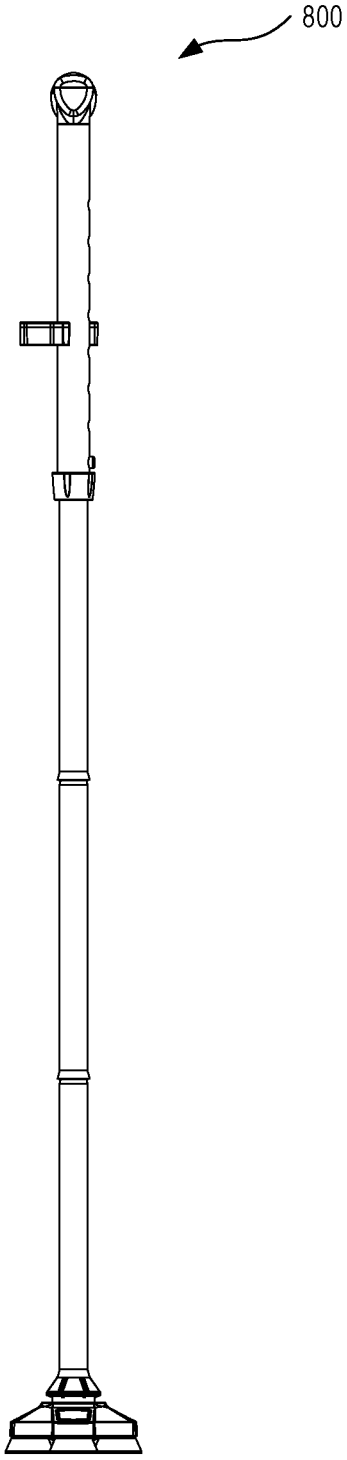
FIG. 8I is a left view of an extended walking aid, according to an example.
Figure 8J:
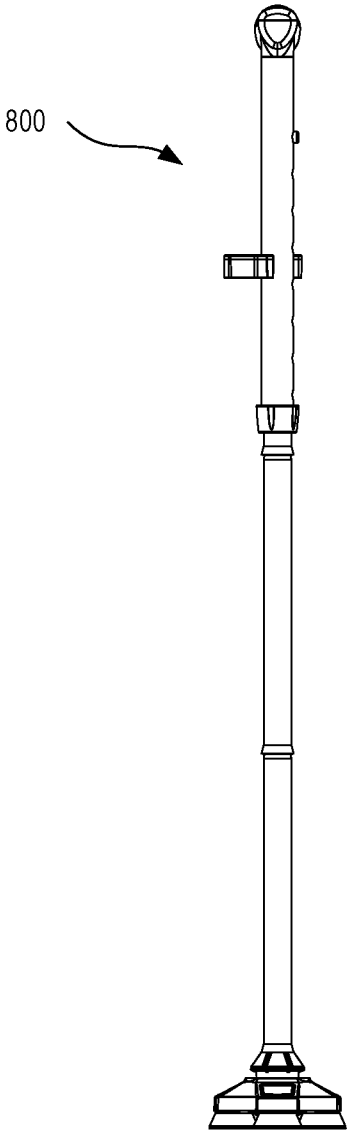
FIG. 8J is a left view of a retracted walking aid, according to an example.
Figure 8L:
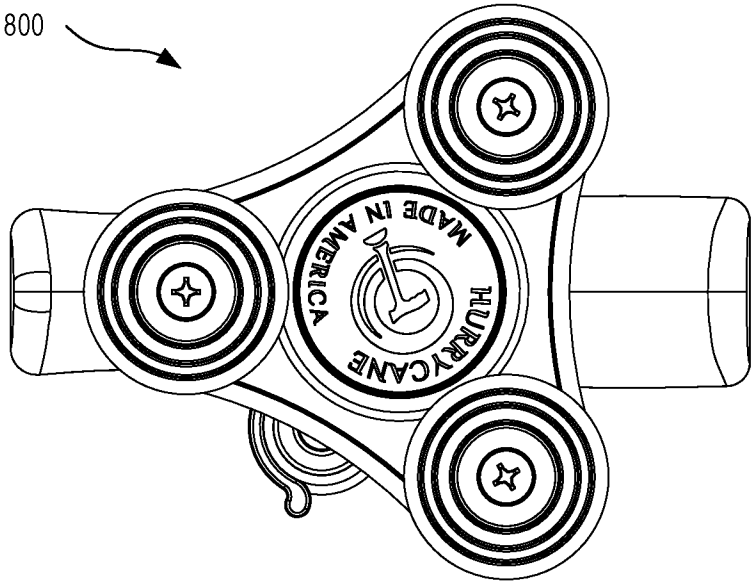
FIG. 8L is a bottom view of a collapsed walking aid, according to an example.
Figure 8K:
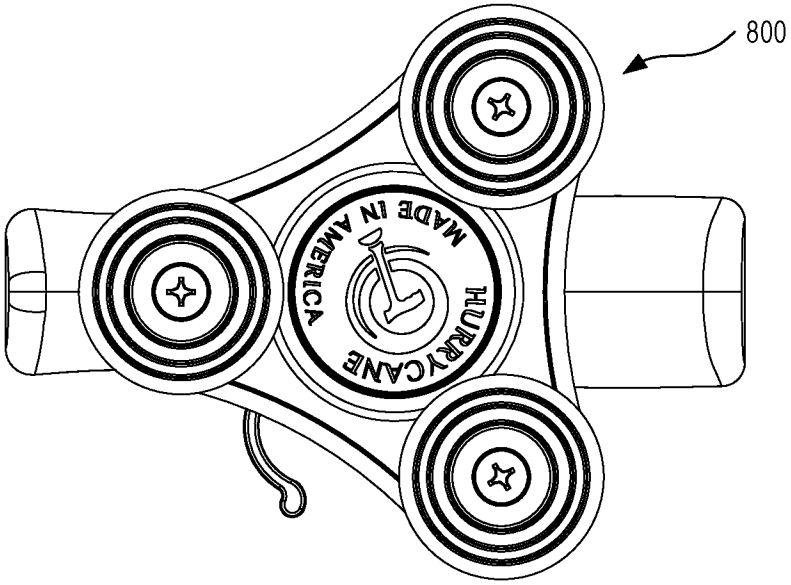
FIG. 8K is a bottom view of a walking aid, according to an example.
Figure 8N:
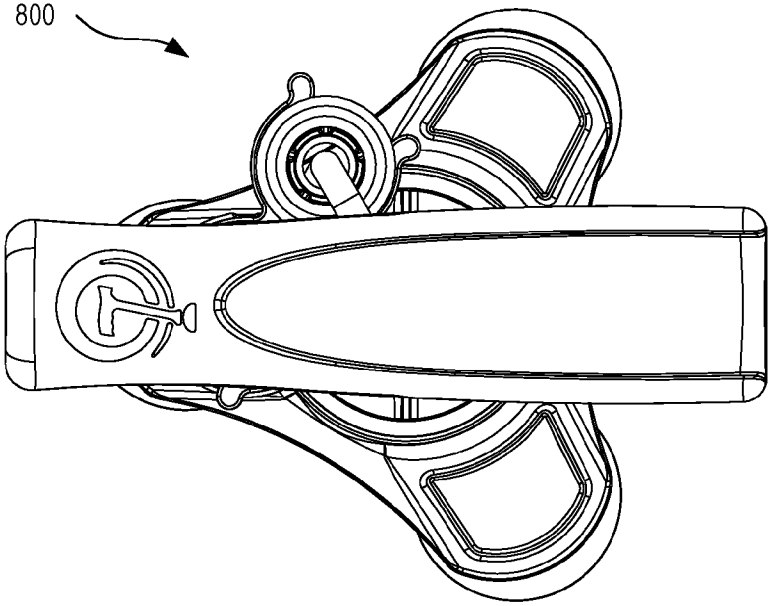
FIG. 8N is a top view of a collapsed walking aid, according to an example.
Figure 8M:
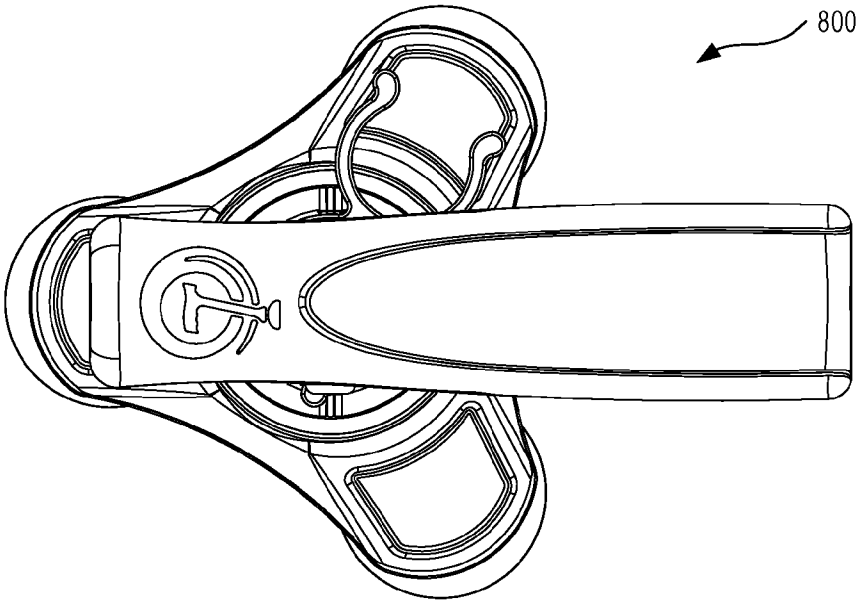
FIG. 8M is a top view of a walking aid, according to an example.

FIGS. 8A-N show views of a three-footed walking aid, according to an example. A walking aid 800 can include an ergonomic grip 844 coupled to a top portion 846 of a handle 814. The grip 844 can extend horizontally across a top portion of the handle 814.

The top portion 846 of the handle 814 can be adjustably extendable. For example, a top part 848 of the top portion 848 can include a plurality of holes 852. A bottom part 854 of the top portion 846 can include a depressible button 856 to mate to one of the plurality of holes 852.

A tightening collar 858 can lock the top part 848 to the bottom part 854. The tightening collar 858 can dispose a collar, generally wedge-shaped in cross-section, between the top part and the bottom part to jam them together.

As shown in FIG. 8B, a clip 860 can fasten collapsed portions 862 of the handle in a side-by-side configuration. As shown in FIG. 8C, the foot 802 can be wider than the handle 814 to resist tipping at a dimension D81 of up to at least 10 degrees of misalignment between the handle and an axis 864 perpendicular to the surface while the foot can be pivoted off the surface. The foot 802 can be wider than the handle 814 to resist tipping at a dimension D81 of up to at least 5 degrees of misalignment between the handle and an axis perpendicular to the surface, while the foot is pivoted off the surface.

FIGS. 9A-H show views of a four-footed walking aid, according to an example. A foot 902 can include four pads 922 spaced apart to define a rectangle, such as a square. The spacing of the pads can be selected to maintain a center of gravity of the walking aid 900 over an axis that bisects the rectangle formed by the pads 922.

Figure 10:
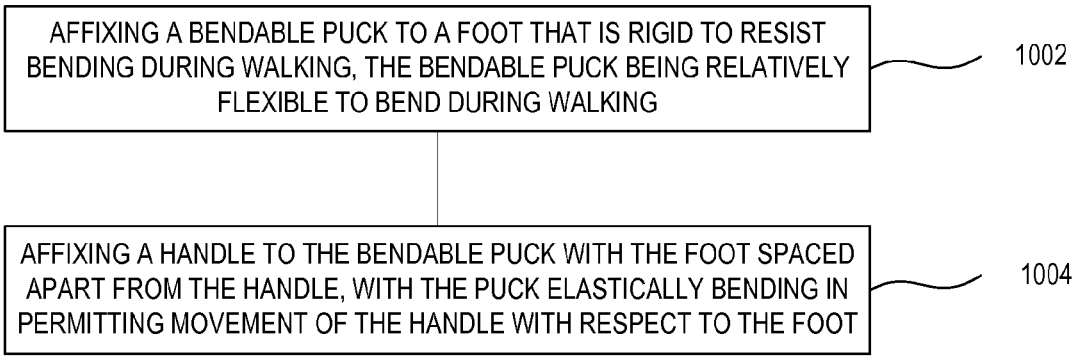
FIG. 10 shows a method of making a walking aid, according to an example.

FIG. 10 shows a method of making a walking aid, according to an example. At 1002, a method can include affixing a bendable puck to a foot, the foot for interfacing with the surface, the foot being rigid to resist bending during walking, the bendable puck being relatively flexible to bend during walking. At 1004, the method can include affixing a handle to the bendable puck with the foot spaced apart from the handle, with the puck elastically bending in permitting movement of the handle with respect to the foot.

Any number of optional methods can be combined with other methods discussed herein. An optional method can include coupling a fastener to the puck and the handle. An optional method can include molding the puck around the fastener. An optional method can include insert molding the puck around the fastener. An optional method can include the handle can be collapsible, and comprising elastically maintaining a band disposed in the handle in tension to maintain the handle in an extended position.

Notes and Examples

Example 1 can include an apparatus for aiding walking along a surface. The Example can include a foot to interface with the surface, the foot being rigid to resist bending during walking. The Example can include a bendable puck fixed to the foot at an edge of the bendable puck. The Example can include a handle coupled to a center portion of the bendable puck, wherein the foot is spaced apart from the handle, with the puck being elastically bendable to permit movement of the handle with respect to the foot during walking.

Example 2 can include, or can optionally be combined with the subject matter of one or any combination of the preceding Examples, comprising top cover of the foot, coupled to a bottom cover of the foot, with the puck sandwiched between the top cover and the bottom cover.

Example 3 can include, or can optionally be combined with the subject matter of one or any combination of the preceding Examples, wherein the foot defines a cavity between the puck and the foot.

Example 4 can include, or can optionally be combined with the subject matter of one or any combination of the preceding Examples, comprising a fastener coupled to the puck and the handle, through the puck, with a bottom portion of the fastener extending below the bendable puck.

Example 5 can include, or can optionally be combined with the subject matter of one or any combination of the preceding Examples, wherein the bottom end of the fastener is sandwiched between the bendable puck and the foot Example 6 can include, or can optionally be combined with the subject matter of one or any combination of the preceding Examples, wherein the bottom portion of the fastener is disposed in the cavity.

Example 7 can include, or can optionally be combined with the subject matter of one or any combination of the preceding Examples, wherein the handle is spaced apart from the bendable puck.

Example 8 can include, or can optionally be combined with the subject matter of one or any combination of the preceding Examples, comprising a fastener coupled to the puck and the handle, the puck molded around the fastener.

Example 9 can include, or can optionally be combined with the subject matter of one or any combination of the preceding Examples, wherein the fastener includes a disk-shaped portion, with the puck molded around the disk-shaped portion, with a threaded portion extending away from the disk-shaped portion, extending through the puck upward, with the handle coupled with the threaded portion.

Example 10 can include, or can optionally be combined with the subject matter of one or any combination of the preceding Examples, wherein the foot includes a housing that is conformed to the puck and at least partially envelops the puck, with the threaded portion extending through the housing, with the housing spaced apart from the threaded portion.

Example 11 can include, or can optionally be combined with the subject matter of one or any combination of the preceding Examples, wherein the housing includes a first housing portion coupled to a second housing portion to retain the bendable puck.

Example 12 can include, or can optionally be combined with the subject matter of one or any combination of the preceding Examples, wherein at least one housing fastener couples the first housing portion to the second housing portion.

Example 13 can include, or can optionally be combined with the subject matter of one or any combination of the preceding Examples, wherein the at least one pad fastener couples a pad to the housing.

Example 14 can include, or can optionally be combined with the subject matter of one or any combination of the preceding Examples, wherein the foot includes a housing, with a cavity disposed between the housing and the puck.

Example 15 can include, or can optionally be combined with the subject matter of one or any combination of the preceding Examples, wherein the cavity is disposed in the housing.

Example 16 can include, or can optionally be combined with the subject matter of one or any combination of the preceding Examples, wherein a perimeter of the cavity is wider than the fastener.

Example 17 can include, or can optionally be combined with the subject matter of one or any combination of the preceding Examples, wherein a perimeter of the cavity along a horizontal cross-section, encircles a perimeter of the fastener taken along a second horizontal cross-section parallel a first horizontal cross-section.

Example 18 can include, or can optionally be combined with the subject matter of one or any combination of the preceding Examples, wherein the perimeter of the cavity is wider than a housing opening through which the fastener extends.

Example 19 can include, or can optionally be combined with the subject matter of one or any combination of the preceding Examples, wherein the handle extends through the housing opening, with the housing spaced apart from the handle.

Example 20 can include, or can optionally be combined with the subject matter of one or any combination of the preceding Examples, wherein the puck is suspended inside the housing, defining the cavity below it.

Example 21 can include, or can optionally be combined with the subject matter of one or any combination of the preceding Examples, comprising a fastener coupled to a top of the puck.

Example 22 can include, or can optionally be combined with the subject matter of one or any combination of the preceding Examples, wherein the fastener is adhered to the puck.

Example 23 can include, or can optionally be combined with the subject matter of one or any combination of the preceding Examples, wherein the fastener is coupled to the puck with fasteners.

Example 24 can include, or can optionally be combined with the subject matter of one or any combination of the preceding Examples, wherein the foot includes a housing that includes two covers coupled together to retain the bendable puck.

Example 25 can include, or can optionally be combined with the subject matter of one or any combination of the preceding Examples, wherein the handle extends through the puck.

Example 26 can include, or can optionally be combined with the subject matter of one or any combination of the preceding Examples, wherein the foot includes a plurality of frustoconical pads.

Example 27 can include, or can optionally be combined with the subject matter of one or any combination of the preceding Examples, wherein the frustoconical pads are wider at a bottom than at a top.

Example 28 can include, or can optionally be combined with the subject matter of one or any combination of the preceding Examples, including an apparatus for aiding walking along a surface. The Example can include a foot to interface with the surface, the foot being rigid to resist bending during walking. The Example can include a bendable puck fixed to the foot at an edge of the bendable puck. The Example can include a handle that is collapsible coupled to a center portion of the bendable puck. The Example can include an ergonomic grip coupled to a top of the handle, extending horizontally across a top portion of the handle, wherein the foot is spaced apart from the handle, with the puck being elastically bendable to permit movement of the handle with respect to the foot during walking.

Example 29 can include, or can optionally be combined with the subject matter of one or any combination of the preceding Examples, wherein a bottom portion of the handle is coupled to a hook to couple with an elastic band disposed in the handle.

Example 30 can include, or can optionally be combined with the subject matter of one or any combination of the preceding Examples, wherein a top portion of the handle is adjustably extendable.

Example 31 can include, or can optionally be combined with the subject matter of one or any combination of the preceding Examples, wherein a top part of the top portion includes a plurality of holes, and a bottom part of the top portion includes a depressible button to mate to one of the plurality of holes.

Example 32 can include, or can optionally be combined with the subject matter of one or any combination of the preceding Examples, comprising a tightening collar to lock the top part to the bottom part.

Example 33 can include, or can optionally be combined with the subject matter of one or any combination of the preceding Examples, wherein the tightening collar is to dispose a collar, generally wedge-shaped in cross-section, between the top part and the bottom part.

Example 34 can include, or can optionally be combined with the subject matter of one or any combination of the preceding Examples, comprising a clip to fasten collapsed portions of the handle in a side-by-side configuration.

Example 35 can include, or can optionally be combined with the subject matter of one or any combination of the preceding Examples, wherein the foot is wider than the handle to resist tipping at up to at least 10 degrees of misalignment between the handle and an axis perpendicular to the surface while the foot is pivoted off the surface.

Example 36 can include, or can optionally be combined with the subject matter of one or any combination of the preceding Examples, wherein the apparatus is one of a cane, crutch, walker or prosthetic.

Example 37 can include, or can optionally be combined with the subject matter of one or any combination of the preceding Examples, including a method that can include affixing a bendable puck to a foot, the foot for interfacing with the surface, the foot being rigid to resist bending during walking, the bendable puck being relatively flexible to bend during walking. The Example can include affixing a handle to the bendable puck with the foot spaced apart from the handle, with the puck elastically bending in permitting movement of the handle with respect to the foot.

Example 38 can include, or can optionally be combined with the subject matter of one or any combination of the preceding Examples, comprising coupling a fastener to the puck and the handle.

Example 39 can include, or can optionally be combined with the subject matter of one or any combination of the preceding Examples, comprising molding the puck around the fastener.

Example 40 can include, or can optionally be combined with the subject matter of one or any combination of the preceding Examples, comprising insert molding the puck around the fastener.

Example 41 can include, or can optionally be combined with the subject matter of one or any combination of the preceding Examples, wherein the handle is collapsible, and comprising elastically maintaining a band disposed in the handle in tension to maintain the handle in an extended position.

The above detailed description includes references to the accompanying drawings, which form a part of the detailed description. The drawings show, by way of illustration, specific embodiments in that may be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is to allow the reader to quickly ascertain the nature of the technical disclosure, for example, to comply with 37 C.F.R. §1.72(b) in the United States of America. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the embodiments should be determined with reference to the appended claims, along with the full scope of equivalents to which such claims are entitled.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. An apparatus for aiding walking along a surface, comprising:

a foot to interface with the surface, the foot comprising a rigid housing to resist bending during walking and a plurality of flexible elastomeric footpads separately fastened to a bottom of the rigid housing and configured to flexibly interface with the surface, wherein the rigid housing includes a first housing portion coupled to a second housing portion, wherein at least one pad fastener passes through a corresponding one of the flexible elastomeric footpads and couples the first housing portion to the second housing portion, wherein the at least one pad fastener couples the corresponding one of the flexible elastomeric footpads to the rigid housing;

an elastically bendable polymer puck fixed to the foot at an edge of the bendable puck; and a handle coupled to a center portion of the elastically bendable polymer puck via a metallic fastener extending upwardly from the elastically bendable polymer puck along a central axis of the elastically bendable polymer puck, wherein the foot is spaced apart from the handle, with the puck being elastically bendable to permit movement of the handle with respect to the foot during walking.

2. The apparatus of claim 1, comprising a top cover of the foot, coupled to a bottom cover of the foot, with the puck sandwiched between the top cover and the bottom cover.

3. The apparatus of claim 2, wherein the foot defines a cavity between the puck and the bottom cover.

4. The apparatus of claim 3, wherein the metallic fastener is coupled to the puck and the handle and extends fully through the puck, with a bottom portion of the metallic fastener extending below the bendable puck.

5. The apparatus of claim 4, wherein the bottom end of the metallic fastener is sandwiched between the bendable puck and the foot, wherein the bottom end of the metallic fastener is disposed in the cavity.

6. The apparatus of claim 4, wherein the handle is spaced apart from the bendable puck.

7. The apparatus of claim 3, wherein the puck is integrally molded around the fastener.

8. The apparatus of claim 1, wherein the first housing portion is coupled to the second housing portion so as to retain the bendable puck in an interior space of the rigid housing.

9. The apparatus of claim 1, wherein the metallic fastener is coupled to a top face of the puck.

10. The apparatus of claim 1, wherein the flexible elastomeric footpads comprise a plurality of frustoconical pads, and the frustoconical pads are wider at a bottom than at a top.

* * * * *